United States Patent [19]

Darby et al.

[11] 4,314,390

[45] Feb. 9, 1982

[54] COMPOSITE BURIAL VAULT AND METHOD FOR MAKING SAME

[76] Inventors: James W. Darby, 2117 Smith St., Danville, Ill. 61832; David L. Darby, R.R. #1 Box 458-20, Alvin, Ill. 61811

[21] Appl. No.: 177,218

[22] Filed: Aug. 11, 1980

Related U.S. Application Data

[60] Continuation-in-part of Ser. No. 770,524, Feb. 22, 1977, Pat. No. 4,261,083, which is a division of Ser. No. 522,133, Nov. 8, 1974, Pat. No. 4,060,581.

[51] Int. Cl.[3] ..... A61G 17/00

[52] U.S. Cl. ..... 27/35; 52/135

[58] Field of Search ..... 27/35, 7, 3; 52/128, 52/135, 133, 140

[56] References Cited

U.S. PATENT DOCUMENTS

| | | | |
|---|---|---|---|
| 3,439,461 | 4/1969 | Chandler | 52/139 |
| 3,464,171 | 9/1969 | Chandler | 52/128 X |
| 3,839,768 | 10/1974 | McQuestion | 27/35 |

*Primary Examiner*—John D. Yasko

*Attorney, Agent, or Firm*—Gifford, VanOphem, Sheridan & Sprinkle

[57] ABSTRACT

A composite burial vault is provided having a hollow liner constructed of a synthetic plastic material which is filled with concrete. In constructing the burial vault, a liquid bonding agent is applied against the liner. The bonding agent can be either an adhesive or a solvent which acts upon the plastic material or a combination of the adhesive and the solvent. Before the bonding agent dries, aggregate is applied to the surface of the liner preferably by a flocking gun. Alternatively, the bonding agent and aggregate can be simultaneously sprayed against the liner. As the bonding agent dries, the aggregate is bonded to the liner either by the adhesive and/or by a portion of the aggregate partially embedding in the liner. Concrete is then poured between a mold and the treated surface of the liner where it forms a mechanical bond to the coarse aggregate coating on the liner. Reinforcement strips are provided to strengthen the corner edges of the liner. Preferably, the aggregate is sufficiently small so as to permit stacking of the treated liners and, in one form of the invention, stacking notches are provided around the upper corners of the liner to facilitate stacking the liners upon each other.

32 Claims, 10 Drawing Figures

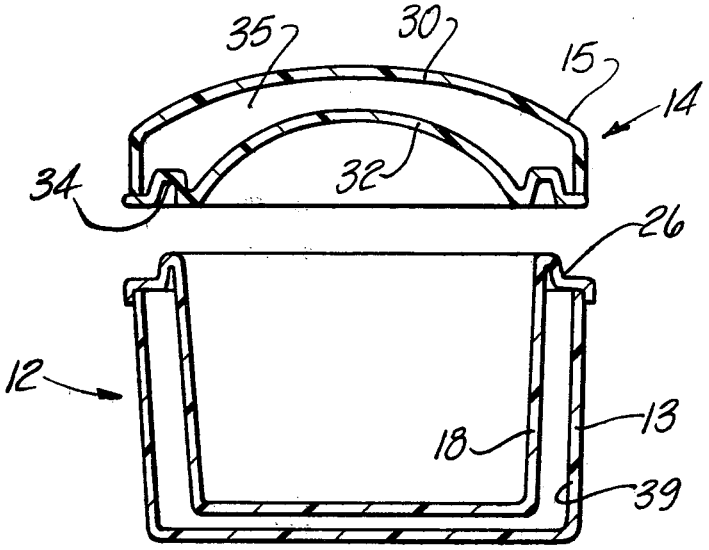
Fig-3
Fig-5
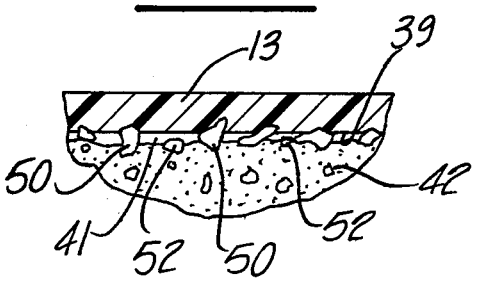
Fig-6
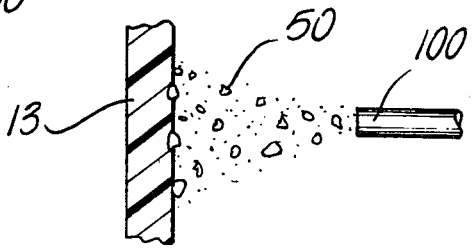

COMPOSITE BURIAL VAULT AND METHOD FOR MAKING SAME

CROSS REFERENCE

This application is a continuation-in-part application of Ser. No. 770,524, filed Feb. 22, 1977, now U.S. Pat. No. 4,261,083 and entitled COMPOSITE BURIAL VAULT, which was a divisional application of patent application Ser. No. 522,133, filed on Nov. 8, 1974 and now U.S. Pat. No. 4,060,581 issued Nov. 29, 1977.

BACKGROUND OF THE INVENTION

I. Field of the Invention

The present invention relates to burial vaults, and, more particularly, to a composite burial vault comprising a plastic resinous liner with concrete mechanically bonded to at least one surface thereof.

II. Description of the Prior Art

Composite burial vaults, such as that described in U.S. Pat. No. 3,439,461 issued to Chandler et al on Apr. 22, 1969, are relatively new in the field. Such burial vaults typically comprise a plastic liner which is coated first with an adhesive and then filled with concrete. Such composite burial vaults have been found to be advantageous in that the concrete provides structural rigidity, while the plastic liner, if it is exterior of the concrete, provides a water resistant wall unlike the more porous cement.

In some arrangements, the liner is for appearance and protection and is disposed interiorly of the burial vault. In still other arrangements, a plastic inner and plastic outer liner are provided with the concrete poured therebetween.

Although these previously known composite burial vaults have been well accepted in the trade, they also have disadvantages of which it is the object of the present invention to eliminate.

The primary disadvantage with the prior art composite burial vaults is that an adhesive must be applied to the liner prior to pouring the concrete into the mold. When the wet concrete is poured against the tacky adhesive, the concrete flow tends to rub the adhesive off the liner. This, in turn, results in only a loose, and therefore undesirable, bond between the liner and the concrete.

My previous method for constructing a burial vault, described in U.S. Pat. No. 4,060,581, overcame many of these problems by providing a method in which an aggregate material is applied against a liner constructed of a thermosetting material before the liner has dried or after a solvent is applied against it. The aggregate becomes partially embedded in the liner and forms a mechanical bonding surface for the concrete. As a practical matter, however, burial vault liners are oftentimes obtainable from the manufacturer only after the thermosetting material has hardened.

SUMMARY OF THE PRESENT INVENTION

The present invention provides an improved burial vault construction.

In the preferred form of the invention, a plastic liner is constructed in any conventional manner known in the trade. Typically, such liners are constructed of a resinous thermosetting material.

A bonding agent comprising a styrene adhesive and/or a solvent which acts upon the liner, is then applied to at least one surface of the liner. Before the bonding agent dries, aggregate is applied to the resinous liner by a flocking gun or any other suitable means. Alternatively, a mixture of the bonding agent and aggregate can be sprayed on the liner. Thus, when the bonding agent dries, the aggregate is bonded to the liner either by the adhesive and/or by at least a portion of the aggregate being partially embedded in the liner. The aggregate provides a coarse finish on the surface of the liner.

When final assembly of the composite burial vault of the present invention is desired, concrete is simply poured into the space provided between a mold and the treated surface of the liner where it mechanically bonds to the coarse aggregate finish on the liner. A three-dimensional mechanical bond rather than a glued bond is thus formed between the concrete and the aggregate.

In one form of the invention reinforcing strips are provided for the corner edges of the liner and in another form of the invention notches are formed on the liner to permit liners to be stacked for shipping and storage.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 3 is a cross-sectional view taken substantially along line 3—3 in FIG. 1;

FIG. 5 is a partial cross-sectional view showing the bond between the liner and the cement and enlarged for clarity;

FIG. 6 is a diagrammatic view illustrating one step in one embodiment of the method of the present invention;

DETAILED DESCRIPTION OF A PREFERRED EMBODIMENT OF THE PRESENT INVENTION

Figure 1:
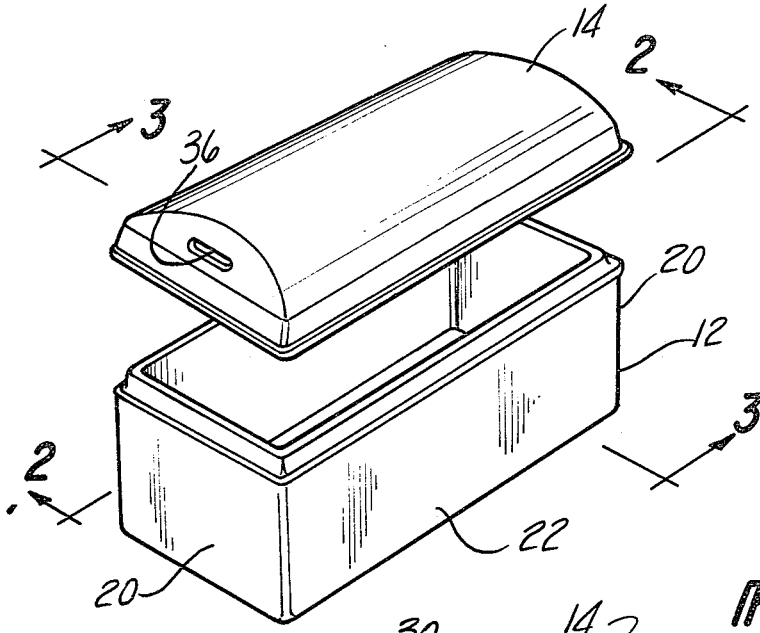
FIG. 1 is a perspective view showing the composite burial vault of the present invention.
Figure 2:
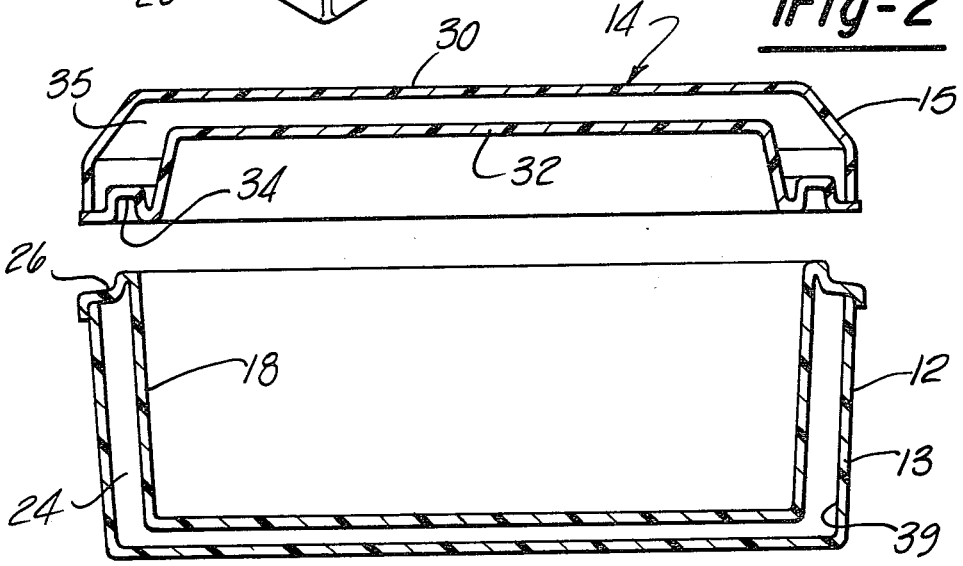
FIG. 2 is a side cross-sectional view taken substantially along line 2—2 in FIG. 1.
Figure 4:
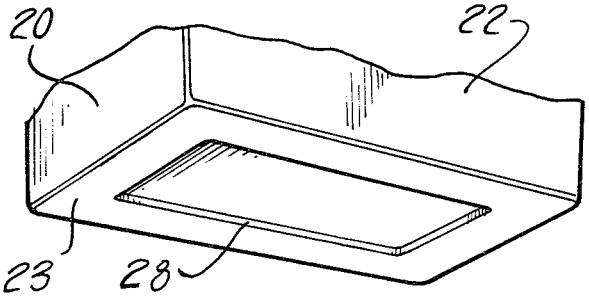
FIG. 4 is a bottom perspective view showing the base of the burial vault of the present invention.

With reference to FIGS. 1-4, a preferred embodiment of the composite burial vault 10 of the present invention is thereshown and generally comprises a lower base 11 having a base liner 12 and an upper lid 14 having a lid liner 15 both of which are constructed of a plastic material. The base liner 12 comprises an outer wall portion 13 having oppposing end walls 20, opposing side walls 22, and a bottom 23. As shown in FIGS. 2 and 3, the base liner 12 further comprises an inner wall portion 18 which is also preferably constructed of a plastic material. The inner wall portion 18 is spaced inwardly from and substantially parallel to the outer wall portion 13 so that a cavity 24 is formed between the outer wall portion 13 and the inner wall portion 18 around the entire periphery of the base liner 12. A web 26 is preferably provided across the upper open end of the inner wall portion 18 and the outer wall portion 13 and preferably the web 26 is constructed of the same material as the wall portions 13 and 18. The inner wall portion 18, the outer wall portion 13 and the web 26 may also be of integral construction. As can best be seen in FIG. 4, a rectangular aperture 28 is provided in the bottom 23 of the outer wall portion 13 in the base liner 12 for a purpose to be hereinafter described.

The lid 14 of the burial vault is constructed in a similar manner as the base portion 11. Specifically, the lid 14 generally comprises the lid liner 15 having an outer wall 30 and an inwardly spaced inner wall 32, both of which are preferably constructed of a plastic material. A web 34 adapted to register with the web 26 is provided between the downwardly extending open end of the wall portions 30 and 32, so that a cavity 35 is formed within the lid liner 15. An aperture 36 is provided through the outer wall portion 30 of the lid liner 15 at one end of the lid 14 for a purpose to be shortly described.

With reference to FIG. 5, the method of constructing the base 12 of the burial vault 10 is as follows: The interior surface 39 of the cavity 24 is coated with a bonding agent 41. The bonding agent 41 comprises either an adhesive or a solvent which acts upon and partly dissolves the liner 12 or a mixture of the adhesive and the solvent, and styrene adhesive is the preferred form of the adhesive. As best shown in FIG. 6, before the bonding agent 41 dries, the interior surface 39 is covered with a granular material 40, hereinafter sometimes referred to as aggregate, preferably by a flocking gun 100, although any other means may be used. The granular material 40 can also comprise comminuted plastic material such as the material from which the liner is constructed.

Alternatively, the bonding agent 41 and aggregate can be simultaneously applied to the liner by spraying a mixture of the bonding agent 41 and aggregate onto the liner 12. The flocking gun 100 shown in FIG. 6 can also be used to spray this mixture.

If the bonding agent 41 comprise a mixture of the solvent and adhesive, at least a portion 50 of the aggregate 40 becomes partially embedded in the liner surface 39 so that when the adhesive dries, this portion 50 of the aggregate 40 is bonded to the liner surface 39 both mechanically by partially embedding in the liner surface 39 and also adhesively by the adhesive. The remainder 52 of the aggregate 40 is adhesively bonded to the liner surface 39 by the adhesive. The aggregate portions 50 and 52 together form a coarse coating or finish on the entire surface 39 of the cavity 24.

At any time subsequent to when the bonding agent 41 dries, a flowable concrete component 42 is poured through the aperture 28 in the bottom 23 of the base 12. The concrete 42 will fill the entire cavity 24 and form a mechanical bond with the aggregate 40 as it dries between the wall portions 13 and 18. It has been found that a strong mechanical bond is formed between the concrete 42 and the wall portions 13 and 18 via the aggregate as the cement dries.

The construction of the lid 14 is substantially identical to the construction of the base 12. Namely, the wall portions 30 and 32 of the lid liner 15 are constructed of plastic material and a bonding agent containing an adhesive and/or a solvent is applied to the walls of the cavity 35 formed between the wall portions 30 and 32. Aggregate 40 is then applied against the lining of the cavity so that if the bonding agent contains a solvent, at least a portion of the aggregate becomes embedded in the cavity walls. As the bonding agent hardens, the aggregate 40 provides a coarse surface on the inner lining of the cavity 35. Concrete is then poured through the aperture 36 in the outer wall portion 30 of the lid liner 15, and bonds to the coarse inner surface of the wall portions 30 and 32 in substantially the same manner as described above with respect to the base 12.

Like the base liner 12, a mixture of the bonding agent 41 and the aggregate 40 can be simultaneously sprayed onto the lid liner 15.

It should be understood that although a double wall base 12 and lid 15 have been thus far described, commonly known burial vaults are provided with only an inner liner corresponding to the inner liner portion 18 or an outer liner corresponding to the outer liner portion 13. In such a construction, aggregate is applied to one side of the liner while the bonding agent is still wet as previously described. Which side of the liner that the aggregate is applied will, of course, depend upon whether the liner is an inner liner or an outer liner. After the liner has dried, concrete is applied, preferably by using a mold, to the aggregate coated side of the liner to complete the burial vault.

In addition, the aggregate is sufficiently small to permit stacking of the liners having only an inner or outer wall one upon the other.

Preferably, the bonding agent 41 is a mixture of adhesive and solvent. The attachment of the aggregate to the liner walls both by partially embedding the aggregate in the liner walls and also by the adhesive bond provides a firmer attachment of the aggregate to the liner walls then can be achieved by simply gluing the aggregate to the liner walls. This in turn provides a lasting and secure bond between the concrete and the liner.

Figure 7:
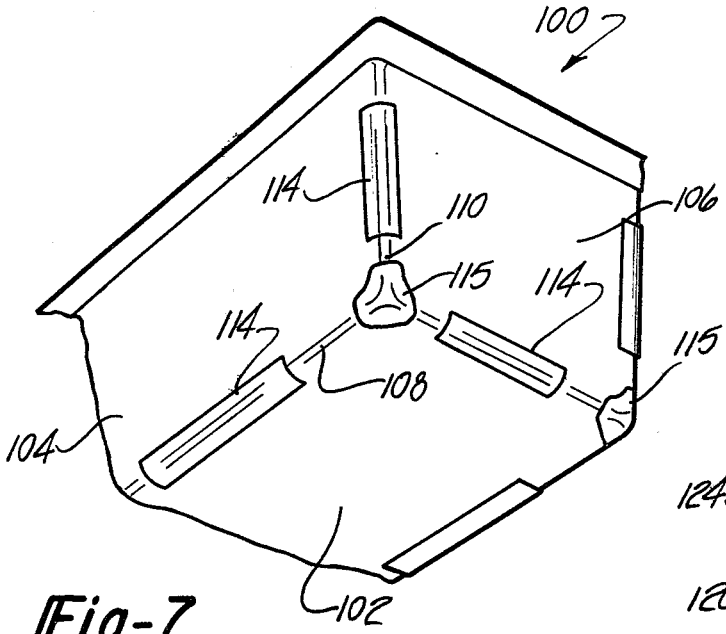
FIG. 7 is a fragmentary view of a modified form of the burial vault of the present invention.

With reference now to FIG. 7, a still further modification of the burial vault of the present invention is thereshown and comprises a liner 100 having a base wall 102, side wall 104 and end wall 106. The liner 100 is integrally formed from a plastic material and, in the preferred form of the invention, is formed by vacuum molding. In the vacuum forming process, the edge 108 between the base wall 102 and side wall 104 and the edge 110 between the side wall 104 and end wall 106 are relatively thin and form a weak area on the liner which is susceptible to fracture and breakage.

Still referring to FIG. 7, a reinforcing strip 114 preferably constructed of fiberglass is secured along one or more of the edges 108 and 110 by a solvent and/or glue. The reinforcing strips 114 effectively thicken the edges 108 and 110, thus reducing the possibility of fracture along the edges 108 and 110, without the necessity of using thicker material for the entire liner.

Similarly, reinforcement patches 115 are provided at corners as shown in FIG. 7.

Figure 9:
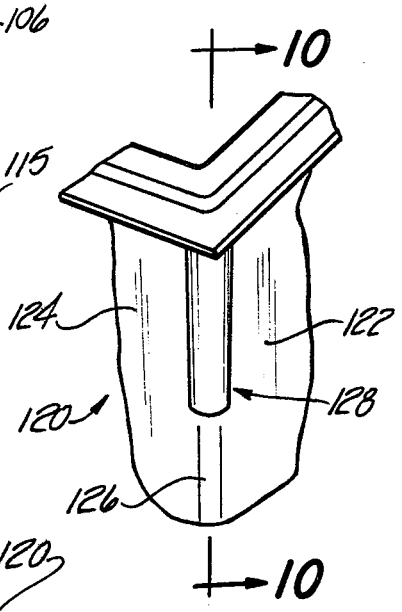
FIG. 9 is a fragmentary view showing a portion of one liner shown in FIG. 8.
Figure 8:
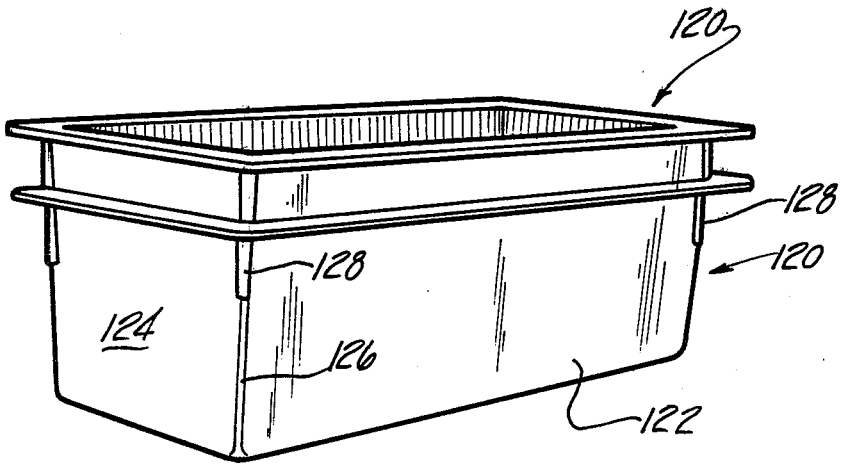
FIG. 8 is an elevational view of liners for the burial vault with means for stacking the liners.

With reference now to FIGS. 8 and 9, a still further liner 120 for a burial vault is thereshown in which the liner is only an inner or outer liner. As such, the liner 120 includes two opposed side walls 122 (only one shown) and two opposed end walls 124 (only one shown). The liner is integrally constructed thus forming a vertically extending edge 126 at the junction of each end and side wall 124 and 122, respectively. Each edge 126, furthermore, tapers outwardly so that the liners 120 can be stacked upon each other and also so that a portion of an upper liner 120 is nested within the interior of the liner beneath it as is best shown in FIG. 8. Stacking the liners permits them to be more easily stored and shipped but with relatively fragile liners, such as those which are vacuum formed, breakage often occurs.

Figure 10:
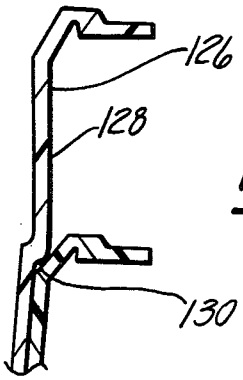
FIG. 10 is a fragmentary sectional view taken substantially along line 10—10 in FIG. 9.

In order to prevent the stacked liners 120 from jamming together, breaking, and becoming difficult to separate, an outwardly protruding stacking notch 128 having a lower abutment surface 130 (FIG. 10) is formed adjacent the top of each vertical edge 126 of the liner 120. The stacking notch 128 is dimensioned so that as the liners are stacked upon each other, the surfaces 130 on the stacking notches 128 contact and are supported by the upper edge of the next lower liner. The stacking notches 128 thus facilitate the separation of the stacked liners 120 by limiting the insertion of an upper liner 120 into the next lower liner.

Having thus described our invention, many modifications thereto will become apparent to those skilled in the art without deviating from the spirit of the invention as defined by the scope of the appended claims.

We claim:

1. A method of forming a composite burial vault comprising the steps:

constructing a liner of plastic material;

after said liner has been formed, applying an adhesive containing a solvent to at least one surface of said liner to thereby temporarily soften the surface;

while said liner is soft and before the adhesive has hardened again, applying a granular material to said surface of said liner, said granular material being applied to substantially all of said surface, whereby when said adhesive has dried, at least a portion of said granular material will be partially embedded into said surface of said liner, whereby said portion of said granular material is both mechanically and adhesively bonded to said surface, the remaining portion of said granular material being adhesively bonded to said liner; and after said liner has dried with said granular material embedded therein, pouring a flowable concrete material into contact with said surface and said granular material and permitting said concrete material to dry whereby said granular material will act as a mechanical bond between said liner and the hardened concrete material.

2. The invention as defined in claim 1 wherein said granular material is applied to said surface of said liner by a flocking gun.

3. The method as defined in claim 1 and in which there is sufficient time lag between the time said granular material has been embedded into said liner and the time said concrete material has been bonded to said liner to permit transportion and storage of said liner.

4. The method as defined in claim 1 wherein said adhesive is a styrene adhesive containing the solvent.

5. A composite burial vault comprising:

a plastic liner;

an adhesive containing a plastic solvent applied to at least one surface of said liner;

a granular material, at least a portion of said granular material being partially embedded and both mechanically and adhesively bonded to said at least one surface of said liner, the remainder of said granular material being adhesively bonded to said liner, so that said granular material forms a coarse finish on said at least one surface of said liner; and a flowable concrete component being disposed onto and over said coarse surface of said liner so that said concrete component forms a mechanical bond to said coarse surface of said liner.

6. The invention as defined in claim 5 wherein said adhesive is styrene adhesive.

7. The invention as defined in claim 5 wherein said granular material is aggregate.

8. The invention as defined in claim 5 wherein said granular material is communited plastic.

9. The invention as defined in claim 5 wherein the granular material is sufficiently small so as to permit like dimensioned liners to be stacked one upon the other.

10. The invention as defined in claim 5 wherein said coarse surface of said liner is an interior surface.

11. The invention as defined in claim 5 wherein said coarse surface of said liner is an exterior surface.

12. The invention as defined in claim 5 wherein said liner comprises a closed and generally vertically extending wall defining a cavity and at least two outwardly protruding stacking notches formed on said liner adjacent its upper end.

13. The invention as defined in claim 12 wherein each stacking notch has a lower abutment surface dimensioned to engage and be supported by the upper edge of a lower liner upon which said liner is stacked.

14. The invention as defined in claim 5 wherein said liner comprises at least two wall sections which are joined together to form an edge, and further comprising a reinforcing strip secured to said liner along said edge.

15. A method of forming a composite burial vault comprising the steps of:

constructing a liner of plastic material, applying a mixture of a granular material and a bonding agent to at least one surface of the liner so that as said bonding agent dries, said aggregate is attached to said at least one surface of the liner, and after said bonding agent has dried, pouring a flowable concrete material into contact which said at least one surface of said liner and permitting said concrete material to dry whereby said granular material will act as a mechanical bond between said liner and the hardened concrete material.

16. The method as defined in claim 15 wherein said mixture is applied to said at least one surface of said liner by a flocking gun.

17. The method as defined in claim 15 wherein said applying step further comprises spraying the mixture of the bonding agent and the granular material against said at least one surface of the liner.

18. The method as defined in claim 15 wherein the bonding agent comprises an adhesive.

19. The method as defined in claim 18 wherein the bonding agent further comprises a solvent which acts upon the plastic liner so that said granular material becomes partially embedded in said at least one surface of the liner and so that, when said bonding agent has dried, at least a portion of the granular material is partially embedded into said surface of said liner.

20. The method as defined in claim 15 wherein said bonding agent comprises a solvent which acts upon the plastic liner.

21. The invention as defined in claim 10 wherein said adhesive is a styrene adhesive.

22. A composite burial vault comprising a plastic liner a granular material attached to at least one surface of the liner by simultaneously applying a mixture of said granular material and a bonding agent to said at least one surface of the liner so that when the bonding agent dries, said granular material is bonded to said surface of said liner, and a flowable concrete component being disposed onto and over said surface of said liner after said bonding agent has dried.

23. The invention as defined in claim 22 wherein said mixture is applied to said surface of said liner by a flocking gun.

24. The invention as defined in claim 22 wherein said bonding agent is a mixture of an adhesive and a solvent which acts upon the plastic liner.

25. The invention as defined in claim 22 wherein said bonding agent comprises an adhesive.

26. The invention as defined in claim 22 wherein said bonding agent comprises a solvent which acts upon the plastic liner.

27. The invention as defined in claim 24 wherein at least a portion of the granular material is partially embedded in said surface of said liner.

28. The invention as defined in claim 22 wherein said granular material is aggregate.

29. The invention as defined in claim 22 wherein said granular material is comminuted plastic.

30. The invention as defined in claim 22 wherein said liner comprises a closed and generally vertically extending wall defining a cavity and at least two outwardly protruding stacking notches formed on said liner adjacent its upper end.

31. The invention as defined in claim 30 wherein each stacking notch has a lower abutment surface dimensioned to engage and be supported by the upper edge of a lower liner upon which said liner is stacked.

32. The invention as defined in claim 22 wherein said liner comprises at least two wall sections which are joined together to form an edge, and further comprising a reinforcing strip secured to said liner along said edge.

* * * * *